US011156942B2

(12) United States Patent
Kim

(10) Patent No.: US 11,156,942 B2
(45) Date of Patent: Oct. 26, 2021

(54) CLEANING DEVICE FOR INTERMEDIATE TRANSFER BELT

(71) Applicant: HEWLETT-PACKARD DEVELOPMENT COMPANY, L.P., Spring, TX (US)

(72) Inventor: Wonkook Kim, Suwon (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/044,040

(22) PCT Filed: Apr. 5, 2019

(86) PCT No.: PCT/US2019/026041
§ 371 (c)(1),
(2) Date: Sep. 30, 2020

(87) PCT Pub. No.: WO2019/209489
PCT Pub. Date: Oct. 31, 2019

(65) Prior Publication Data

US 2021/0109463 A1 Apr. 15, 2021

(30) Foreign Application Priority Data

Apr. 23, 2018 (KR) ..... 10-2018-0046736

(51) Int. Cl.
*G03G 15/16* (2006.01)

(52) U.S. Cl.
CPC ..... *G03G 15/161* (2013.01)

(58) Field of Classification Search
CPC ..... G03G 15/161
See application file for complete search history.

(56) References Cited

U.S. PATENT DOCUMENTS

| | | | | |
|---|---|---|---|---|
| 4,869,921 | A | 9/1989 | Gabel et al. | |
| 5,600,405 | A | 2/1997 | Umeda et al. | |
| 5,953,994 | A | 9/1999 | Seefried | |
| 6,029,575 | A | 2/2000 | Bischer | |
| 6,035,158 | A * | 3/2000 | Asakura | G03G 15/0131 399/101 |
| 6,640,079 | B2 | 10/2003 | Lim et al. | |

(Continued)

FOREIGN PATENT DOCUMENTS

| | | |
|---|---|---|
| JP | H11119623 | 4/1999 |
| JP | 20020072706 | 3/2002 |
| JP | 20050250039 | 9/2005 |

*Primary Examiner* — Clayton E. LaBalle
*Assistant Examiner* — Michael A Harrison
(74) *Attorney, Agent, or Firm* — Staas & Halsey, LLP

(57) ABSTRACT

An image forming apparatus includes a photoreceptor, an intermediate transfer belt, a driving roller, and a cleaning device. The photoreceptor is to have an image formed thereon. The intermediate transfer belt is to be disposed to transfer the image formed on the photoreceptor. The driving roller is to move the intermediate transfer belt in a running direction. The cleaning device is to be disposed in a space formed by the intermediate transfer belt to remove a waste toner introduced into the space. The cleaning device includes a brush roller to be disposed to contact with the intermediate transfer belt and to rotate in an inverse direction of the running direction of the intermediate transfer belt.

20 Claims, 13 Drawing Sheets

(56) References Cited

U.S. PATENT DOCUMENTS

| | | | | |
|---|---|---|---|---|
| 7,265,768 | B2 | 9/2007 | Aoki et al. | |
| 2010/0098460 | A1* | 4/2010 | Noguchi ..... | G03G 15/161 399/149 |
| 2010/0294154 | A1 | 11/2010 | Rapkin et al. | |

* cited by examiner

【Figure 1】
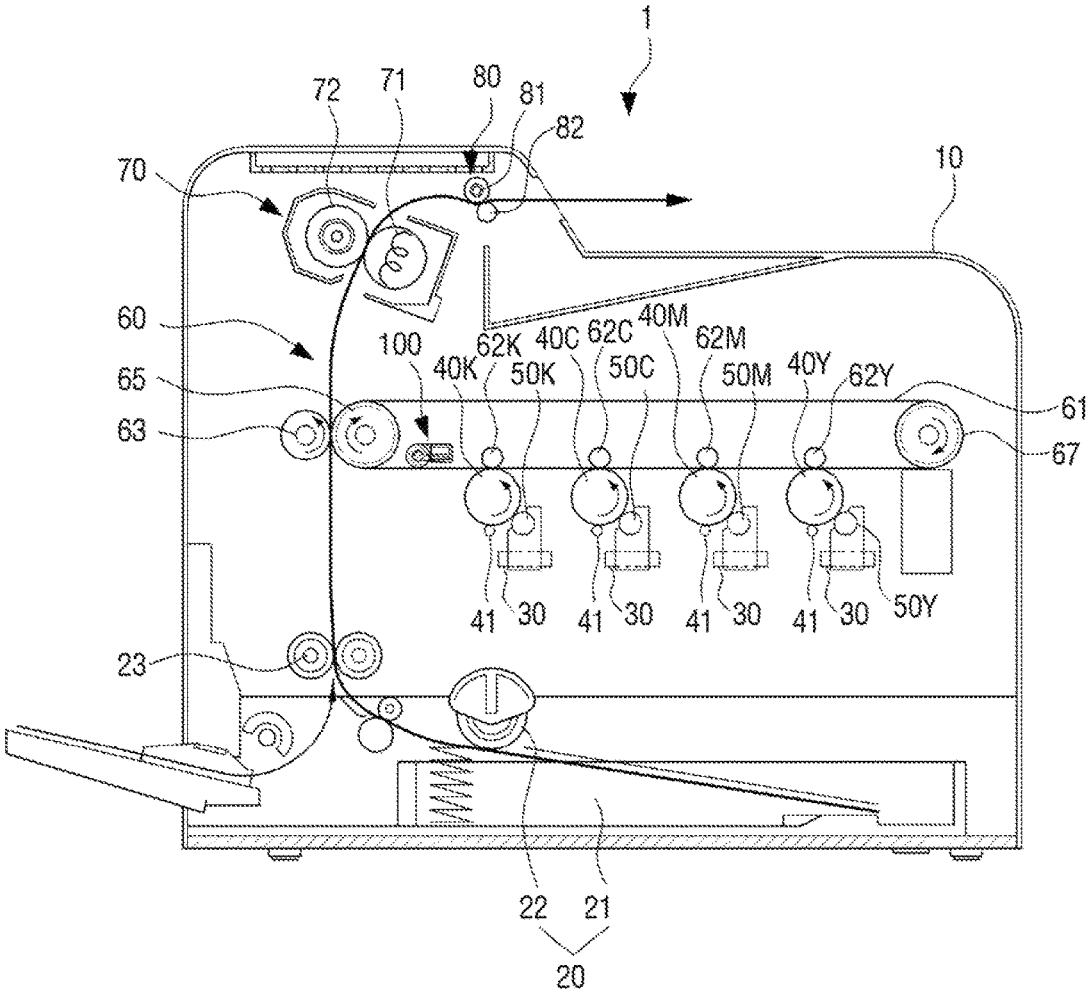

【Figure 2】
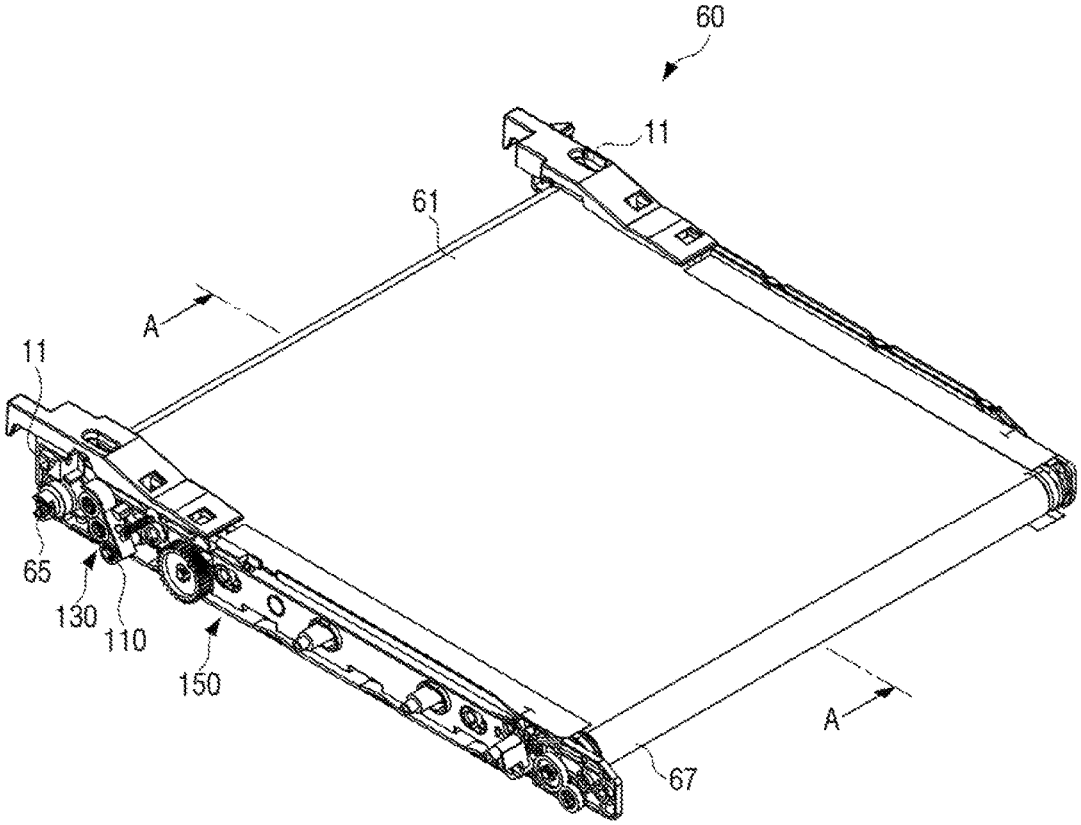

【Figure 3a】
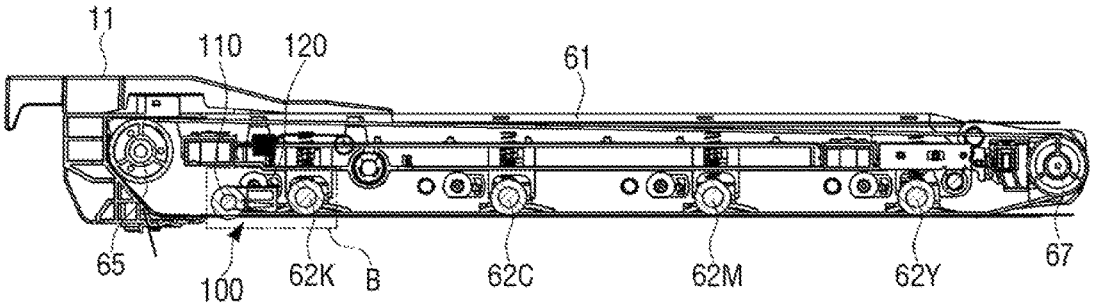

【Figure 3b】
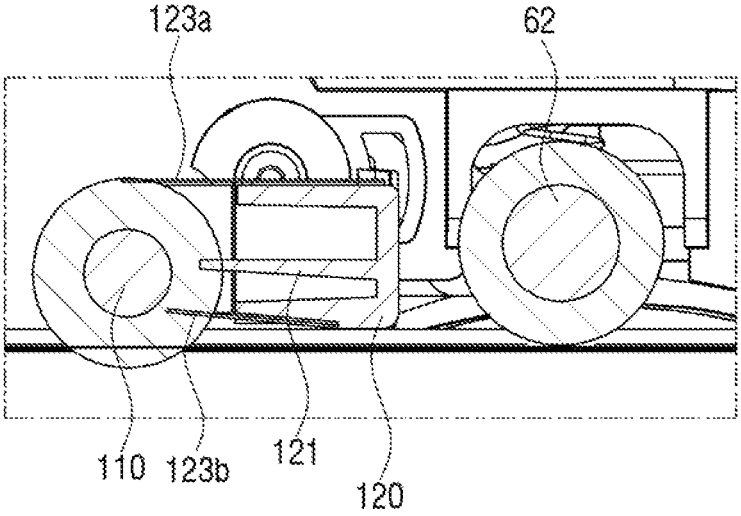

【Figure 4】
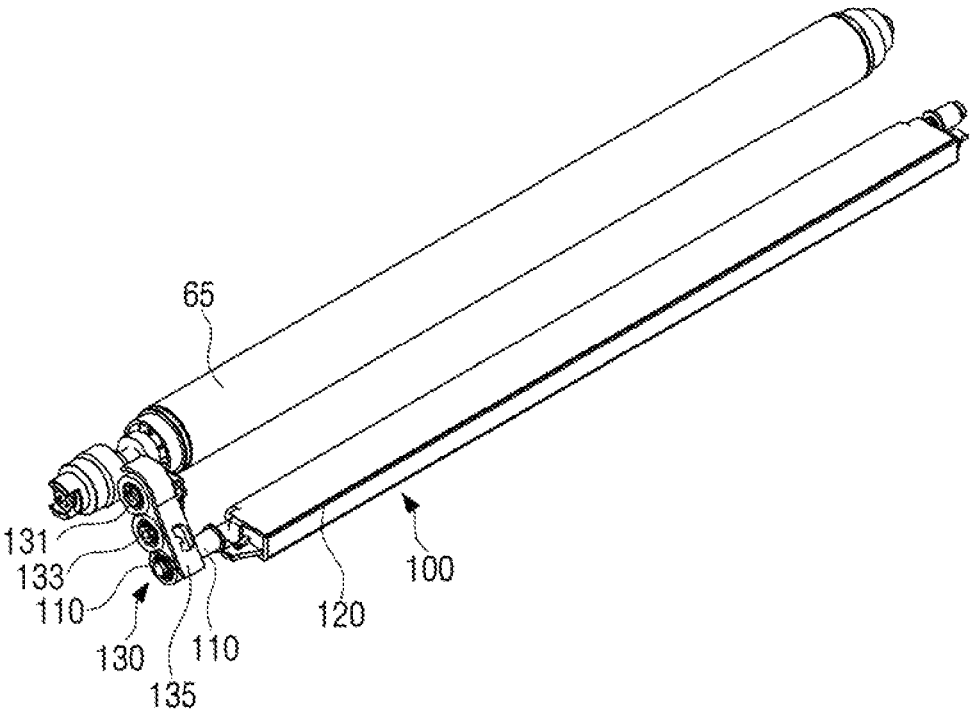

【Figure 5】
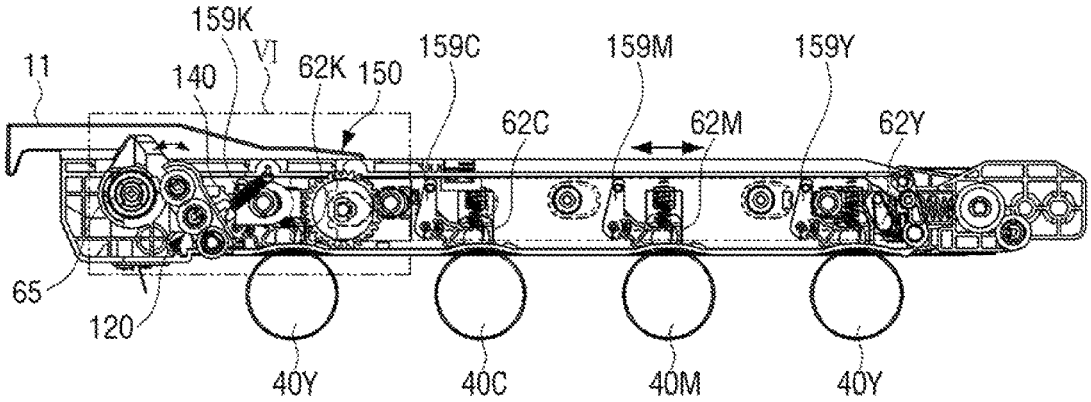

【Figure 6】
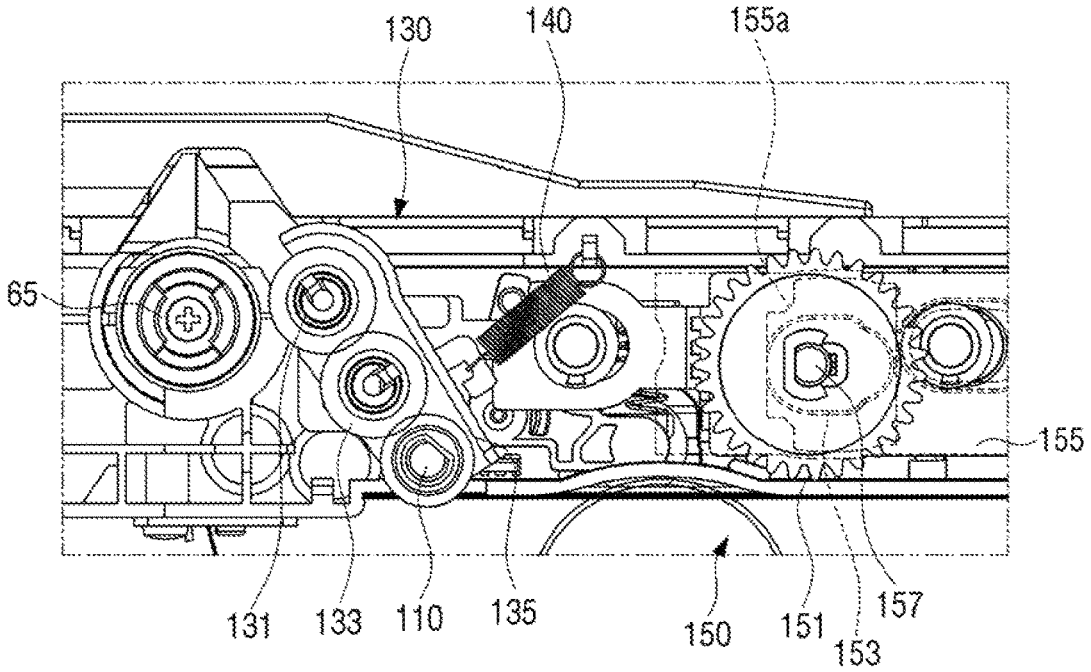

【Figure 7a】
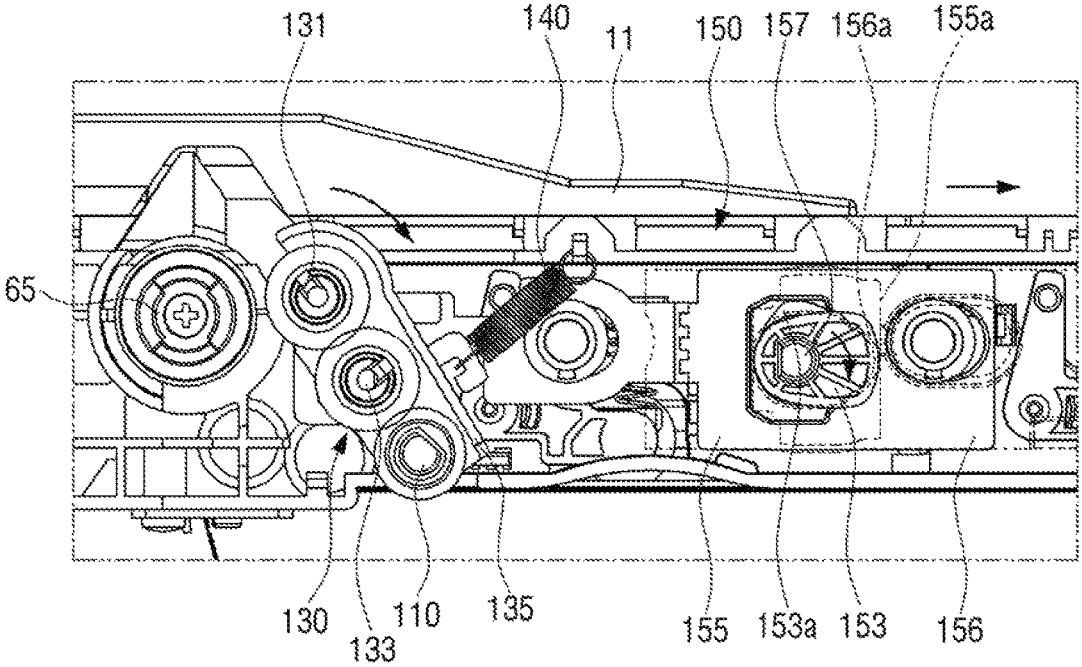

【Figure 7b】
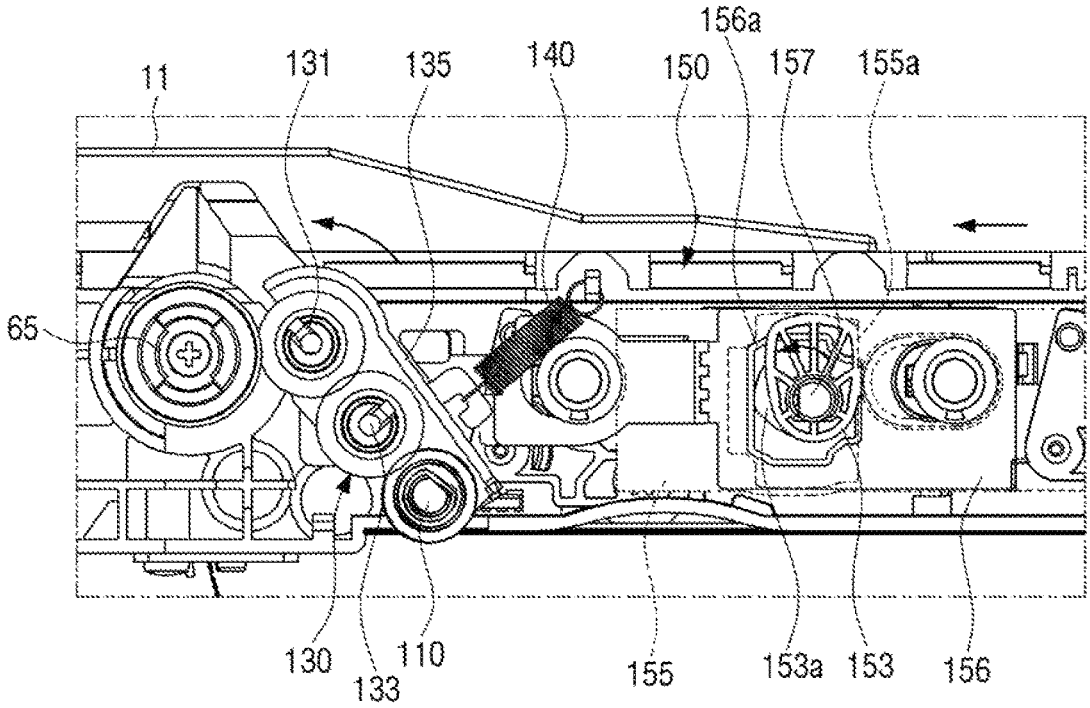

【Figure 8】
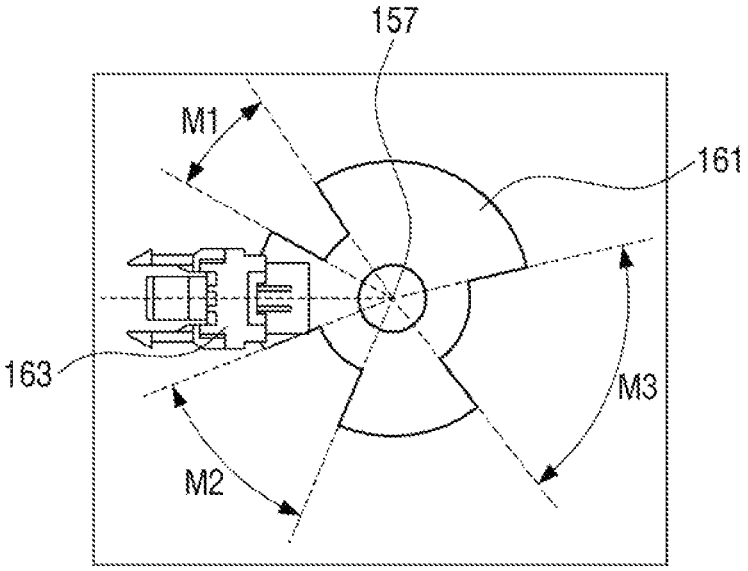

【Figure 9】
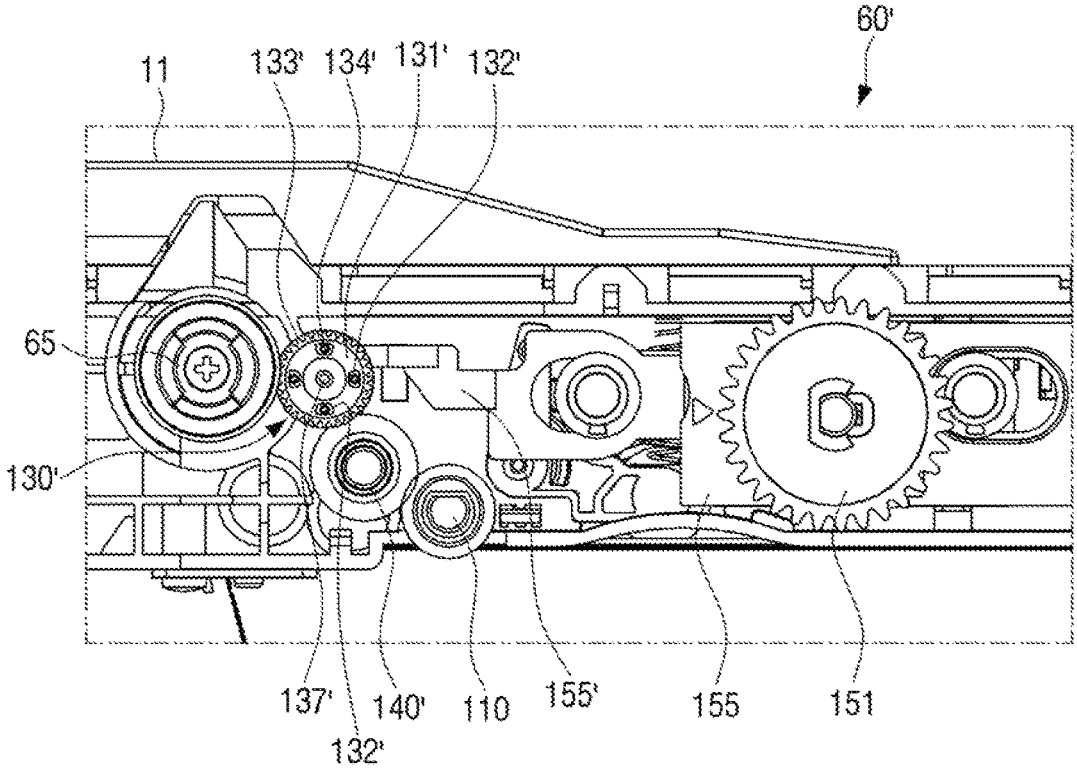

【Figure 10a】
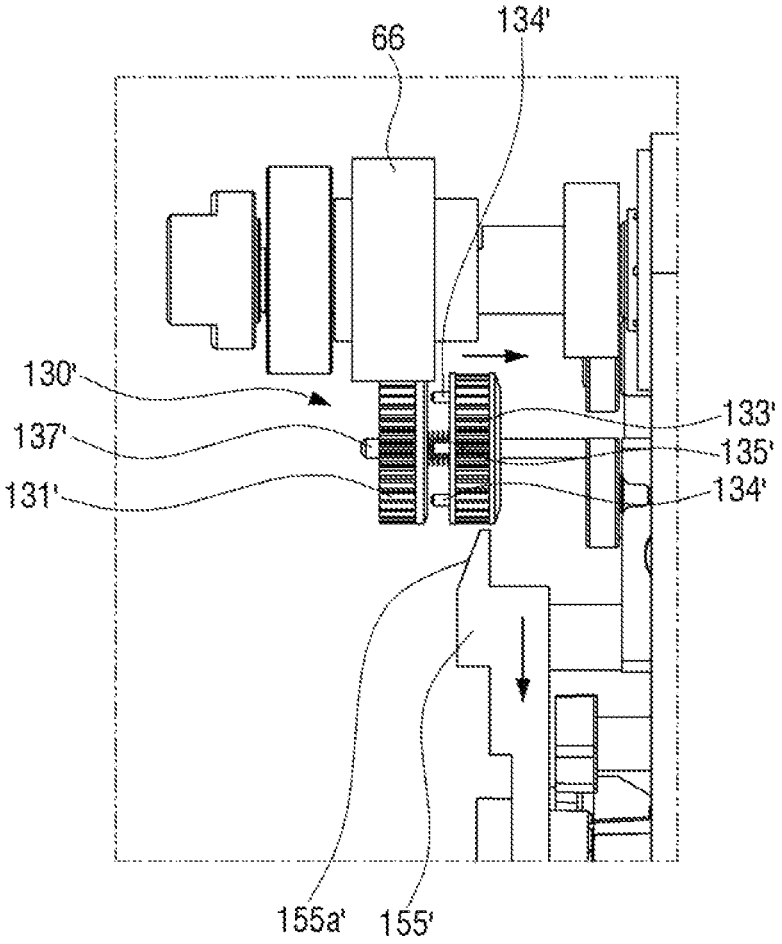

【Figure 10b】
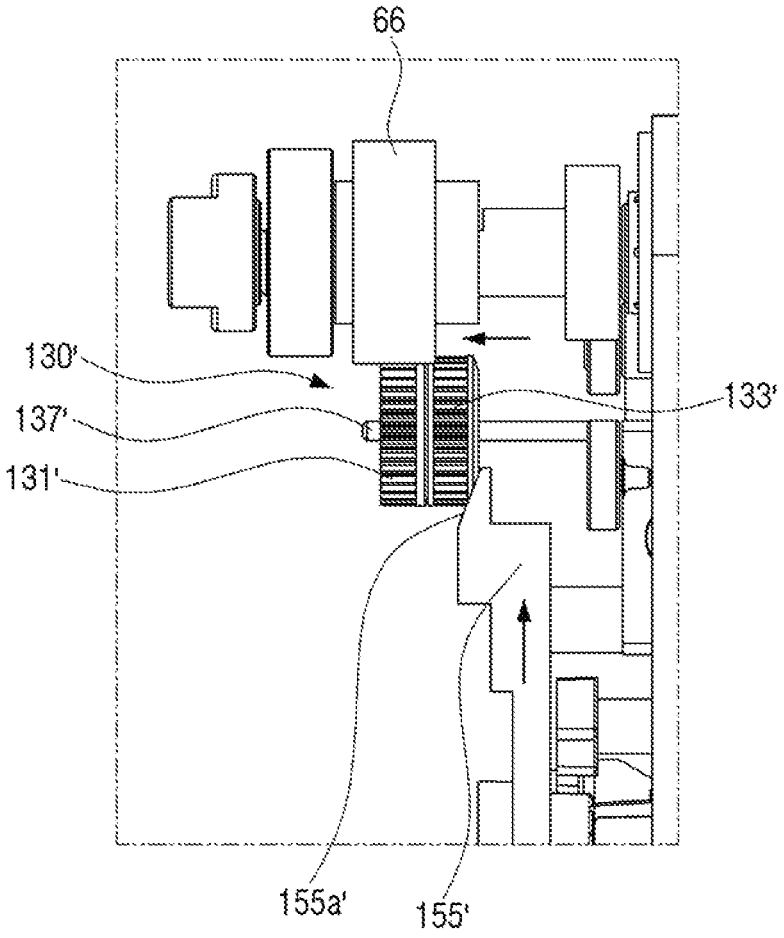

CLEANING DEVICE FOR INTERMEDIATE TRANSFER BELT

CROSS REFERENCE TO RELATED APPLICATIONS

This application is a U.S. National Stage Application which claims the benefit under 35 U.S.C. § 371 of International Patent Application No. PCT/US2019/026041 filed on Apr. 5, 2019, which claims priority from Korean Patent Application No. 10-2018-0046736 filed on Apr. 23, 2018, the contents of each of which are incorporated herein by reference in their entireties.

BACKGROUND

An example of an image forming apparatus which is a device performing generation, printing, reception, transmission, or the like, of image data may include a printer, a copier, a facsimile, and a multi-function printer of integrating and implementing functions thereof.

The image forming apparatus forms an electrostatic latent image by irradiating light modulated to correspond to image information onto a photoreceptor, develops the electrostatic latent image to a visible toner image by supplying a toner to the electrostatic latent image, and prints an image on a print medium by transferring and fixing the toner image to the print medium.

For a color printing, toner images formed of different colors are formed on a plurality of photoreceptors, and the toner images are transferred to a recording medium directly or through an intermediate transfer belt, and are then fixed thereto.

The image forming apparatus using the intermediate transfer belt forms a transferred image by overlapping developer images of the respective colors formed on the photoreceptors, and then transfers the transferred image to the print medium. In this case, the plurality of developer images formed on the photoreceptors are separately formed on the receptors by the corresponding developing device and are then transferred to the intermediate transfer belt to be overlapped with each other.

BRIEF DESCRIPTION OF THE DRAWINGS

FIG. 1 is a view schematically illustrating an image forming apparatus according to an example of the present disclosure;

FIG. 2 is a perspective view of a transferring device according to an example of the present disclosure;

FIG. 3A is a cross-sectional view taken along a line A-A indicated in FIG. 2;

FIG. 3B is an enlarged view of a portion B indicated in FIG. 3A;

FIG. 4 is a perspective view of a driving roller, a cleaning device, and a gear device of the transferring device according to an example of the present disclosure;

FIG. 5 is a front view of a transferring device and a photoreceptor according to an example of the present disclosure;

FIG. 6 is an enlarged view of a portion VI indicated in FIG. 5;

FIG. 7A is a view illustrating a state in which the transferring device according to an example of the present disclosure is in a print mode;

FIG. 7B is a view illustrating a state in which the transferring device according to an example of the present disclosure is in a standby mode;

FIG. 8 is a view illustrating a sensor for sensing a mode of the transferring device according to an example of the present disclosure;

FIG. 9 is an enlarged view of a front of a transferring device according to another example of the present disclosure;

FIG. 10A is a view illustrating a state in which the transferring device according to another example of the present disclosure is in a print mode; and FIG. 10B is a view illustrating a state in which the transferring device according to another example of the present disclosure is in a standby mode.

DETAILED DESCRIPTION

Hereinafter, various examples of the present disclosure will be described in detail with reference to the accompanying drawings. The examples to be described below may also be modified in various forms.

Meanwhile, in the present specification, a case in which any component is "connected" with another component includes a case in which any component is 'directly connected' to another component and a case in which any component is 'connected to another component while having the other component interposed therebetween'. In addition, a case in which any component "comprises" another component may refer to any component may further comprise other components, not exclude other components, unless explicitly described to the contrary.

In the present specification, an "image forming job" may refer to various jobs (e.g., a printing, a scan, or a fax) related to an image such as formation of the image or generation/storing/transmission of an image file, and a "job" may refer to the image forming job, but also to a series of processes to perform the image forming job.

In addition, an "image forming device" refers to a device of printing print data generated from a terminal such as a computer on a recoding paper. Examples of the image forming apparatus described above may include a copier, a printer, a facsimile, a multi function printer (MFP) of complexly implementing functions thereof through a single device, or the like. The image forming apparatus may mean all devices capable of performing an image forming job, such as the printer, the scanner, the fax machine, the multi-function printer (MFP), or a display.

In addition, a "hard copy" may mean an operation of outputting the image to a print medium such a paper or the like, and a "soft copy" may mean an operation of outputting the image to the display device such as a TV, a monitor, or the like.

In addition, "contents" may mean all kinds of data that are subjected to the image forming job, such as photos, images, document files, or the like.

In addition, "print data" may mean data converted into printable format by the printer. Meanwhile, when the printer supports a direct printing, a file itself may be the print data.

In addition, a "user" may mean a person performing an operation related to the image forming job using the image forming device, or using a device which is connected wired/wirelessly with the image forming device. In addition, a "manager" may mean a person having authority to access all the functions and a system of the image forming device. The "manager" and the "user" may also be the same person.

FIG. 1 is a view schematically illustrating an image forming apparatus according to an example of the present disclosure.

As illustrated in FIG. 1, an image forming apparatus 1 according to an example of the present disclosure includes a main body 10, a print medium supplying device 20, an exposure device 30, a photoreceptor 40, a developing device 50, a transferring device 60, a fixing device 70, and a print medium discharging device 80.

The main body 10 forms an outer shape of the image forming apparatus 1 and supports a variety of components installed therein.

The print medium supplying device 20 supplies a print medium S toward the transferring device 60. The print medium supplying device 20 includes a cassette 21 in which the print medium is stored, a pick-up roller 22 for picking up the print medium stored in the cassette 21 one by one, and a transport roller 23 for transporting the picked-up print medium S toward the transferring device 60.

The exposure device 30 is disposed below the developing device 50 to form an electrostatic latent image on a surface of the photoreceptor 40 by scanning light corresponding to image information to the photoreceptor 40.

The photoreceptor 40 has a photoconductive layer formed on an outer periphery of a cylindrical metal drum. The photoreceptor 40 is an image carrier for carrying the electrostatic latent image formed by the exposure device 30 and a developer image formed by the developing device 50. The photoreceptor 40 may be rotatably installed in the main body 10.

A charging roller 41 is installed in the main body 10. The charging roller 41 charges the photoreceptor 40 with a predetermined potential before the light is scanned from the exposure device 30. The charging roller 41 is one example of a charger for charging the photoreceptor 40 with a uniform potential. The charging roller 41 charges an outer circumferential surface of the photoreceptor 40 with a uniform potential by supplying charges while being rotated in a state in which it is in contact with or not in contact with the outer circumferential surface of the photoreceptor 40. As the charger, a corona discharger may also be adopted in stead of the charging roller 41.

The developing device 50 forms the developer image by supplying a developer to the photoreceptor 40 on which the electrostatic latent image is formed. The developing device 50 includes four developing machines 50Y, 50M, 50C, and 50K in which developers having different colors, for example, developers having yellow (Y), magenta (M), cyan (C), and black (K) colors are accommodated, respectively.

The developer to be supplied to the photoreceptor 40 is stored in each of the developing machines 50Y, 50M, 50C, and 50K, and the stored developer is attached onto the surface of the photoreceptor 40 on which the electrostatic latent image is formed to form the developer image.

The transferring device 60 may include an intermediate transferring belt 61 and an intermediate transfer roller 62.

The intermediate transfer belt 61 is an image carrier for carrying the developer image formed by the developing device 50. The intermediate transfer belt 61 is supported by a driving roller 65 and a driven roller 67 and is run at the same velocity as linear velocity of the photoreceptor 40. A length of the intermediate transfer belt 61 is equal to or at least longer than a length of the print medium S having a maximum size used in the image forming device.

The intermediate transfer roller 62 faces the respective photoreceptors 40 while having the intermediate transfer belt 61 interposed therebetween to allow the developer images formed on the respective photoreceptors 40 to be transferred to the intermediate transfer belt 61. A plurality of intermediate transfer rollers 62Y, 62M, 62C, and 62K may be formed to correspond to the respective photoreceptors 40. The intermediate transfer roller 62 is applied with a first transfer bias voltage for transferring the developer image formed on the photoreceptor 40 to the intermediate transfer belt 61. The first transfer bias voltage is a voltage having a polarity opposite to that of the developer. When the first transfer bias voltage is applied to the intermediate roller 62, the respective developer images formed on the photoreceptor 40 are transferred to the intermediate transfer belt 61 to be overlapped with each other, thereby forming a primarily transferred image. A material of the intermediate transfer rollers 62K, 62C, 62M, and 62Y is not limited, but the intermediate transfer rollers 62K, 62C, 62M, and 62Y may be formed, for example, a steel material, and may perform the transfer without being directly in contact with the photoreceptors 40K, 40C, 40M, and 40Y upon transferring.

In addition, the transferring device 60 may include a final transfer roller 63.

The final transfer roller 63 faces the driving roller 65 while having the intermediate transfer belt 61 interposed therebetween. The final transfer roller 63 is spaced apart from the intermediate transfer belt 61 while the image is transferred from the photoreceptor 40 to the intermediate transfer belt 61, and is in contact with the intermediate transfer belt 61 at a predetermined pressure when the image of the photoreceptor 40 is completely transferred to the intermediate transfer belt 61. When the final transfer roller 63 is in contact with the intermediate transfer belt 61, the image of the intermediate transfer belt 61 is transferred to the print medium S. The final transfer roller 63 is applied with a second transfer bias voltage for transferring the developer image to the print medium S. The second transfer bias voltage is a voltage having a polarity opposite to that of the developer. When the second bias voltage is applied to the final transfer roller 63, the primarily transferred image formed on the intermediate transfer belt 61 is transferred to the print medium S transported by the print medium supplying device 20 as a secondarily transferred image.

The fixing device 70 includes a heating roller 71 having a heat source, and a compressing roller 72 installed to face to the heating roller 71. When the print medium S passes between the heating roller 71 and the compressing roller 72, the image is fixed onto the print medium S by heat transferred from the heating roller 71 and pressure acting between the heating roller 71 and the compressing roller 72.

The print medium discharging device 80 includes a paper discharging roller 81 and a paper discharging backup roller 82 to discharge the print medium S passing through the fixing device 70 to the outside of the main body 10.

Meanwhile, the image forming apparatus 1 according to an example of the present disclosure includes a cleaning device 100 disposed to be in contact with an inner portion of the intermediate transfer belt 61, and a gear device 130 and a switching device 150 for driving the cleaning device 100.

The cleaning device 100 is to remove foreign materials introduced into the intermediate transfer rollers 62K, 62C, 62M, and 62Y. The cleaning device 100 is disposed inside a space formed by the intermediate transfer belt 61 to remove the toner which is introduced into the intermediate transfer belt 61 and which is not transferred and remains. The cleaning device 100 is physically in contact with and removes the waste toner remaining on an inner circumferential surface of the intermediate transfer belt after the transfer to the print medium S is performed.

The cleaning device 100 includes a brush roller 110 that scrapes out the water toner remaining on the inner surface of the intermediate transfer belt 61 by friction with the intermediate transfer belt 61. The cleaning device 100 may further include a waste toner collecting box 120 for collecting the waste toner in addition to the brush roller 110.

The cleaning device 100 may be driven by the driving roller 65 of the intermediate transfer belt 61. A cleaning driving device for driving the cleaning device 100 may include the gear device 130 and the switching device 150.

The gear device 130 connecting the driving roller 65 with the cleaning device 100 may be in contact with or separated from the driving roller 65 depending on a movement of the switching device 150 in a main scanning direction.

When the gear device 130 is in contact with the driving roller 65, the cleaning device 100 may clean the inside of the intermediate transfer belt 61 and when the gear device 130 is separated from the driving roller 65, the cleaning device 100 may not receive driving force.

The cleaning device 100 may individually move to correspond to a preset print mode according to a print command of the image forming apparatus 1 according to an example of the present disclosure. The preset print mode may be classified into, for example, a print mode in which the print is performed, and a standby mode in which the print is not performed. As an example, the print mode may include a mono print mode and a color print mode.

The cleaning device 100 is not driven in the print mode and the cleaning device 100 is driven in the standby mode to clean the inside of the intermediate transfer belt 61.

A detailed configuration and operation of the cleaning device 100 will be described below.

FIG. 2 is a perspective view of a transferring device according to an example of the present disclosure and FIG. 3A is a cross-sectional view taken along a line A-A indicated in FIG. 2.

Referring to FIGS. 2 and 3A, the transferring device 60 includes a frame 11 that rotatably supports the driving roller 65 and the driven roller 67. In addition, the transferring device 60 may further include a cleaning device 100 that cleans an inner side surface opposite to an outer side surface to which the image is transferred from the intermediate transfer belt 61.

The cleaning device 100 is disposed within a closed loop formed by the intermediate transfer belt 61 to solve an issue in that the toner scattered in a developing process of the image forming apparatus 1 enters an inside of the intermediate transfer belt 61 to cause scratches on the intermediate transfer belt 61 and contaminate the transfer rollers 62K, 62C, 62M, and 62Y disposed therein to cause image defects.

The cleaning device 100 may be disposed to be able to be in contact with the inner side surface of the intermediate belt 61 to clean the inside of the intermediate transfer belt 61. The cleaning device 100 may include a brush roller 110 that rotates in a direction opposite to a running direction of the intermediate transfer belt 61. The brush roller 110 rotates by receiving the driving force of the driving roller 65 and the cleaning device 100 may be disposed to be adjacent to the driving roller 65. A detailed configuration of the cleaning device 100 will be described below with reference to FIG. 3B.

The frame 11 may be coupled to a main body frame (not shown) or may be integrated with the main body 10. The frame 11 may be configured as a pair facing each other to support both end portions of the driving roller 65 and the driven roller 67.

The gear device 130 capable of transferring the driving force to the cleaning device 100 and the switching device 150 capable of moving the gear device 130 may be disposed on an outer side of the frame 11.

The gear device 130 is in contact with or separated from the driving roller 65 to transfer the driving force to the cleaning device 100, and may include a plurality of gears.

The switching device 150 may individually move to correspond to a preset print mode according to a print command of the image forming apparatus 1.

In the mono print mode and the color print mode, depending on the movement of the switching device 150, the gear device 130 is separated from the driving roller 65 and the cleaning device 100 is not driven. In the standby mode, depending on the movement of the switching device 150, the gear device 130 may be in contact with the driving roller 65, and the cleaning device 100 may be driven by receiving rotation force of the driving roller 65 to clean the inner side surface of the intermediate transfer belt 61. A detailed configuration and driving method of the gear device 130 and the switching device 150 will be described below, FIG. 3B is an enlarged view of a portion B indicated in FIG. 3A.

A detailed configuration of the cleaning device 100 will be described with reference to FIG. 3B.

The cleaning device 100 is to remove foreign materials such as the waste toner, paper powder, and the like which are introduced into the intermediate transfer belt 61, and may be disposed to be able to be in contact with the intermediate transfer belt 61.

The cleaning device 100 may include a brush roller 110, a blade 121, a waste toner collecting box 120, and blocking members 123*a* and 123*b*.

The cleaning device 100 includes the brush roller 110 that rotates in a direction opposite to a running direction of the intermediate transfer belt 61. The cleaning device 100 may use the brush roller 110 to reduce a load caused by a contact with the intermediate transfer belt 61. A brush may be formed on an outer circumferential surface of the brush roller 110 to remove the toner. The brush roller 110 rotates in a reverse direction opposite to the running direction of the intermediate transfer belt 61 while being in contact with the inside of the intermediate transfer belt 61. A cleaning efficiency may be further increased by the rotation in the reverse direction of the brush roller 110. The remaining toner and the paper powder on the inner surface of the intermediate transfer belt 61 may be removed by a surface of the brush roller 110.

The brush roller 110 may be connected to the driving roller 65, which is the rotational driving force of the intermediate transfer belt 61, and rotate. The brush roller 110 may be connected to the driving roller 65 by the gear device 130 to be described below. The brush roller 110 may rotate in the direction opposite to the running direction of the intermediate transfer belt 61 to easily remove the waste toner attached onto the inside surface of the intermediate transfer belt 61 by friction force with the intermediate transfer belt 61.

In addition, the cleaning device 100 may further include the blade 121 for scrapping out the waste toner remaining on the surface of the brush roller 110. The blade 121 may extend to the brush roller 110 and physically scrape out the brush roller 110 to remove the waste toner attached onto the brush roller 110.

Since the blade 121 may brush off the waste toner seated on the brush roller 110, it is possible to prevent the inside of the intermediate transfer belt 61 being re-contaminated by the brush roller 110.

The cleaning device 100 may further include the waste toner collecting box 120 for collecting at least one foreign material of the waste toner and the paper powder which are separated from the brush roller 110. The waste toner collecting box 120 may be disposed to be adjacent to the brush roller 110. The blade 121 may be extended from the waste toner collecting box 120.

The waste toner collecting box 120 may be coupled to the brush roller 110. By the above-mentioned configuration, the waste toner remaining on the intermediate transfer belt 61 is removed by the brush roller 110, and the waste toner transported to the brush roller 110 is removed by the contact with the blade 121 and is collected in the waste toner collecting box 120.

The blocking members 123*a* and 123*b* for sealing between the waste toner collecting box 120 and the brush roller 110 may be formed between the waste toner collecting box 120 and the brush roller 110. The blocking members 123*a* and 123*b* may prevent the waste toner introduced from the brush roller 110 from being moved to a region other than the waste toner collecting box 120. Since the waste toner collecting box 120 may be sealed by the above-mentioned blocking members 123*a* and 123*b*, it is possible to prevent the waste toner being leaked even when the intermediate transfer rollers 62K, 62C, 62M, and 62Y are run or are shaken.

FIG. 4 is a perspective view of a driving roller, a cleaning device, and a gear device of the transferring device according to an example of the present disclosure.

Referring to FIG. 4, the cleaning device 100 may be disposed to be able to be in contact with or separated from the driving roller 65 by the gear device 130.

The gear device 130 may rotate so that the driving roller 65 and the cleaning device 100 are connected to or separated from each other to correspond to a preset print mode according to a print command of the image forming apparatus 1.

The gear device 130 may include a plurality of gears. As an example, the gear device 130 may include a first gear 131 which is in contact with the driving roller 65 to receive rotation force, and a second gear 133 that transfers the rotation force to the brush roller 110 from the first gear 131. The gear device 130 may further include a housing 135 including a gear that rotates the first gear 131, the second gear 133, and the brush roller 110. The housing 135 may be rotatably disposed around the brush roller 110.

The gear device 130 may rotate around the brush roller 110 by an elastic member 140 (see FIG. 5) and the switching device which are described below. Accordingly, in the print mode, the gear device 130 may rotate to be separated from the driving roller 65, and in the standby mode, the gear device 130 may rotate to be in contact with the driving roller 65.

FIG. 5 is a front view of a transferring device and a photoreceptor according to an example of the present disclosure.

FIG. 5 is a view transparently illustrating a slide 155 of the switching device 150 to illustrate a holder 159 positioned inside of the switching device 150. Referring to FIG. 5, the frame 11 may be configured as a pair facing each other to support both end portions of the driving roller 65 and the driven roller 67. A plurality of holders 159K, 159C, 159M, and 159Y connected to the plurality of transfer rollers 62K, 62C, 62M, and 62Y, respectively, may be included inside of the pair of frames 11.

The holders 159K, 159C, 159M, and 159Y may each support both end portions of the transfer rollers 62K, 62C, 62M, and 62Y. The holders 159K, 159C, 159M, and 159Y may move the transfer rollers 62K, 62C, 62M, and 62Y so that the transfer rollers 62K, 62C, 62M, and 62Y may approach or be spaced from the photoreceptors 40K, 40C, 40M, and 40Y, or the inside surface of the intermediate transfer belt 61.

The holders 159K, 159C, 159M, and 159Y may be connected to the slide 155 and may be rotatably disposed according to the movement of the slide 155. The holders 159K, 159C, 159M, and 159Y may be separately moved to correspond to the preset print mode by the slide 155.

Hereinafter, a position at which transfer may be performed by contacting the plurality of transfer rollers 62K, 62C, 62M, and 62Y with the photoreceptors 40K, 40C, 40M, and 40Y and the intermediate transfer belt 61 is referred to as a transfer position, and a position at which transfer is not performed by separating the plurality of transfer rollers 62K, 62C, 62M, and 62Y from the photoreceptors 40K, 40C, 40M, and 40Y and the intermediate transfer belt 61 is referred to as a standby position. The transfer position and the standby position are referred to describe the example for convenience, and do not limit the spirit of the present disclosure.

In the print mode, the transfer rollers 62K, 62C, 62M, and 62Y maintain the transfer position. As an example, in the mono print mode, the transfer roller 62K corresponding to the developing machine 50K of a black K color maintains the transfer position, and the remaining transfer rollers 62C, 62M, and 62Y maintain the standby position. In the color print mode, all of the transfer rollers 62K, 62C, 62M, and 62Y maintain the transfer position. In the standby mode in which the print is not performed, the transfer rollers 62K, 62C, 62M, and 62Y maintain the standby position.

The holders 159K, 159C, 159M, and 159Y may move and maintain the transfer rollers 62K, 62C, 62M, and 62Y according to the movement of the slide 155. When the slide 155 moves in a direction of the driving roller 65, the holders 159K, 159C, 159M, and 159Y may rotate in a counterclockwise direction to separate the transfer rollers 62K, 62C, 62M, and 62Y from the photoreceptors 40K, 40C, 40M, and 40Y and the intermediate transfer belt 61. In addition, when the slide 155 moves in an opposite direction of the driving roller 65, the holders 159K, 159C, 159M, and 159Y may rotate in a clockwise direction to bring the transfer rollers 62K, 62C, 62M, and 62Y into contact with the photoreceptors 40K, 40C, 40M, and 40Y and the intermediate transfer belt 61.

FIG. 6 is an enlarged view of a portion VI indicated in FIG. 5.

FIG. 6 is a view transparently illustrating the switching gear 151 to illustrate a cam member 153 positioned inside of the switching gear 151 of the switching device 150.

Referring to FIGS. 5 and 6, the brush roller 110 of the cleaning device 100 may be connected to or separated from the driving roller 65 according to the preset print mode. The preset print mode may be classified into, for example, a print mode in which the print is performed, and a standby mode in which the print is not performed. In the print mode, the cleaning device 100 may be separated from the driving roller 65, and in the standby mode, the cleaning device 100 may be connected to the driving roller 65.

The cleaning device 100 may include the gear device 130 and the switching device 150 so as to be connected to or separated from the driving roller 65.

The gear device 130 is to transfer the rotation force of the driving roller 65 to the brush roller 110 of the cleaning device 100 and may rotate according to a movement of the switching device 150 to be described below in a main scanning direction.

The gear device 130 may be formed to be rotatable around a rotational shaft of the brush roller 110.

The gear device 130 may be installed to be supported on the frame 11 by the elastic member 140. As an example, one end of the elastic member 140 may be connected to the housing of the gear device 130 and the other end thereof may be connected to the frame 11. The elastic member 140 elastically compresses the gear device 130 in a direction of the standby position at which the gear device 130 is separated from the driving roller 65. A configuration of the elastic member 140 for this is not limited, and the elastic member 140 may be implemented as a coil spring, a plate spring, a fluid spring, or an elastic material such as rubber.

The gear device 130 is positioned so as not to come into directly contact with the drive roller 65 by moving to the transfer position (i.e., rotating in the clockwise direction) by the compression force of the elastic member 140 when the gear device 130 is in the transfer position. The transfer may be performed in a state in which the gear device 130 is separated from the driving roller 65.

The gear device 130 is positioned so as to come into directly contact with the drive roller 65 by moving to the standby position (i.e., rotating in the counterclockwise direction) by being supported by the slide 155 of the switching device 150 when the gear device 130 is in the standby position. The brush roller 110 may rotate to clean the inside of the intermediate transfer belt 61 in a state in which the gear device 130 is in contact with the driving roller 65.

The switching device 150 is to switch the preset mode according to the print command of the image forming apparatus 1, and the switching device 150 may include a switching gear 151, a cam member 153, and a slide 155.

The switching gear 151 may be coupled to a cam shaft 157 that extends in a width direction of the intermediate transfer belt 61. The cam shaft 157 is rotatably coupled to the frame 11 and is rotated by the rotation of the switching gear 151. The switching gear 151 is driven to be rotated according to the print command of the image forming apparatus 1, and may rotate the cam shaft 157 to switch the mode of the image forming apparatus 1. Although it is described that a power transfer gear such as the switching gear 151 is applied as a configuration for rotating the cam shaft 157, the configuration for rotating the cam shaft 157 is not limited thereto, but may be variously designated. For example, a motor (not shown) mounted in the main body 10 may be applied.

The cam member 153 installed on the cam shaft 157 is rotated together by the rotation of the cam shaft 157.

The image forming apparatus 1 may include the cam member 153 coupled to both ends of the cam shaft 157 and rotating in connection with the switching gear 151, and the slide 155 including a contact portion which is in contact with a cam trajectory when the cam member 153 is rotated.

The cam member 153 may move the slide 155 in a horizontal direction while being rotated when the cam shaft 157 is rotated. The slide 155 may move in a sub-scanning direction according to the rotation of the cam member 153.

When the slide 155 is moved in the direction of the driving roller 65 by the cam member 153, the slide 155 may compress the gear device 130 in the direction of the driving roller 65 and rotate the holders 159K, 159C, 159M, and 159Y installed inside of the slide 155 in the counterclockwise direction. In addition, when the slide 155 is moved in the opposite direction of the driving roller 65 by the cam member 153, the slide 155 may be separated from the gear device 130 and rotate the holders 159K, 159C, 159M, and 159Y installed inside of the slide 155 in the clockwise direction.

A position at which the gear device 130 is separated from the driving roller 65 and the brush roller 110 is not rotated by the movement of the slide 155 of the switching device 150 in the opposite direction of the driving roller 65 is referred to as the transfer position, and a position at which the gear device 130 is in contact with the driving roller 65 and the brush roller 110 is rotated by the movement of the slide 155 of the switching device 150 in the direction of the driving roller 65 is referred to as the standby position. The cleaning device 100 may be driven at the standby position without being driven at the transfer position.

FIG. 7A is a view illustrating a state in which the transferring device according to an example of the present disclosure is in a print mode an FIG. 7B is a view illustrating a state in which the transferring device according to an example of the present disclosure is in a standby mode.

Referring to FIG. 7A, in a case in which the image forming apparatus 1 is in the print mode, the switching device 150 may switch the transferring device 60 from the standby mode to the print mode.

The switching gear 151 is rotated by the print command of the image forming apparatus 1, and when the switching gear 151 is rotated in the clockwise direction, the cam member 153 may be rotated in the clockwise direction together with the switching gear 151.

When cam member 153 is rotated in the clockwise direction, the cam member 153 compresses a side surface of the contact portion 155*a* which is in contact with the cam member 153, and the contact portion 155*a* is moved in the opposite direction of the driving roller 65 so that the cam member 153 may rotate along the rotation trajectory. That is, the slide 155 including the contact portion 155*a* is moved in the opposite direction of the driving roller 65.

When the slide 155 is moved in the opposite direction of the driving roller 65, the gear device 130 of which one side is supported by the slide 155 is not in contact with the slide 155. Accordingly, the gear device 130 is rotated in the counterclockwise direction by elastic compression force of the elastic member 140 and may be positioned in a state in which it is separated from the driving roller 65. The gear device 130 may be positioned at the transfer position by the elastic member 140 so as not to be in contact with the driving roller 65.

In addition, when the slide 155 moves in the opposite direction of the driving roller 65, the holders 159K, 159C, 159M, and 159Y may rotate in the clockwise direction to bring the transfer rollers 62K, 62C, 62M, and 62Y into contact with the photoreceptors 40K, 40C, 40M, and 40Y and the intermediate transfer belt 61. Accordingly, the transfer roller 62K, 62C, 62M, and 62Y are disposed to correspond to the photoreceptors 40K, 40C, 40M, and 40Y while having the intermediate transfer belt 61 interposed therebetween, and when the transfer rollers 62K, 62C, 62M, and 62Y are positioned at the transfer position, a transfer bias is applied thereto to transfer a visible image on the photoreceptors 40K, 40C, 40M, and 40Y onto the intermediate transfer belt 61.

As the gear device 130 is positioned at the transfer position, the cleaning device 100 may be maintained in a state in which it is not connected to the driving roller 65. The brush roller 110 of the cleaning device 100 is separated from the driving roller 65 and is not driven in the print mode.

Meanwhile, the print mode of the image forming apparatus 1 may include a mono print mode and a color print mode. In this case, the cam member 153 may further include a convex portion 153*a* for moving one transfer roller 62K corresponding to a developer of a black color to the transfer position. In addition, the slide 155 may further include a second slide 156 for supporting one transfer roller 62K corresponding to the developer of the black color. The slide 155 may support the transfer rollers 62M, 62C, and 62Y corresponding to developers of the remaining colors.

In the mono print mode, the cam member 153 may rotate the holder 159K that supports the transfer roller 62K corresponding to the developing machine 50K of the black K color in the clockwise direction by rotating a smaller angle than in the case of the color print mode. When the convex portion 153 is rotated at a predetermined angle, a second contact portion 156*a* is moved in the opposite direction of the driving roller 65 so as to rotate along the rotation trajectory of the convex portion 153*a* while the convex portion 153*a* compresses a side surface of the second contact portion 156*a* which is in contact with the convex portion 153*a*. That is, the second slide 156 including the second contact portion 156*a* is moved in the opposite direction of the driving roller 65. The convex portion 153*a* may move the second slide 156 in the opposite direction of the driving roller 65 by the rotation of the cam member 153, and the slide 155 may not be moved.

Accordingly, in the mono print mode, the transfer roller 62K corresponding to the developing machine 50K of the black K color may maintain the transfer position, and the remaining transfer rollers 62C, 62M, and 62Y may maintain the standby position.

This classification is due to the difference in the transfer roller units 62C, 62M, 62Y, and 62K that perform transfer in the mono print mode and the color print mode, respectively. Since the image by the black developer is formed in the mono print mode, the transfer by the transfer roller 62K corresponding to the developer of the black color is performed. Since a color image needs to be formed in the color print mode, the transfer by all of the transfer rollers 62M, 62C, 62M, and 62Y is performed together.

Referring to FIG. 7B, in a case in which the image forming apparatus 1 is in the standby mode, the switching device 150 may switch the transferring device 60 from the print mode to the standby mode.

The switching gear 151 is rotated by the print command of the image forming apparatus 1, and when the switching gear 151 is rotated in the counterclockwise direction, the cam member 153 may be rotated in the counterclockwise direction together with the switching gear 151.

When cam member 153 is rotated in the counterclockwise direction, the cam member 153 does not further compress the side surface of the contact portion 155*a* which is in contact with the cam member 153, and the contact portion 155*a* is moved in the direction of the driving roller 65 along the rotation trajectory of the cam member 153. That is, the slide 155 including the contact portion 155*a* is moved horizontally toward the driving roller 65.

When the slide 155 is moved in the direction of the driving roller 65, the slide 155 compresses one side of the gear device 130 in the direction of the driving roller 65. Accordingly, the gear device 130 is rotated in the clockwise direction by compression force of the slide 155 and may be positioned in a state in which it is in contact with the driving roller 65. The gear device 130 may be positioned at the standby position in which it is in contact with the driving roller 65.

In addition, when the slide 155 moves in the direction of the driving roller 65, the holders 159K, 159C, 159M, and 159Y may rotate in the counterclockwise direction to bring the transfer rollers 62K, 62C, 62M, and 62Y into separate from the photoreceptors 40K, 40C, 40M, and 40Y and the intermediate transfer belt 61.

As the gear device 130 is positioned at the standby position, the cleaning device 100 may be connected to the driving roller 65, and the brush roller 110 of the cleaning device 100 may receive the rotation force of the brush roller 65 and rotate. The brush roller 110 that rotates in a direction opposite to the running direction of the intermediate transfer belt 61 may remove the waste toner and the paper powder remaining on the inside surface of the intermediate transfer belt 61.

In the print mode, when the slide 155 rotates the holders 159K, 159C, 159M, and 159Y in the clockwise direction while being moved in the opposite direction of the driving roller 65 by the cam member 153 to bring the transfer rollers 62K, 62C, 62M, and 62Y into contact with the photoreceptors 40K, 40C, 40M, and 40Y and the intermediate transfer belt 61. The gear device 130 does not receive supporting force of the slide 155, such that the gear device 130 may be separated from the driving roller 65 while being rotated in the clockwise direction by the elastic member 140. As the gear device 130 moves to separate the driving roller 65 from the cleaning device 100, the rotation force of the driving roller 65 provided to the brush roller 110 of the cleaning device 100 may be blocked. Therefore, since the cleaning device 100 is not driven upon transferring, the brush roller 110 does not apply any load to the intermediate transfer belt 61.

In the standby mode, the slide 155 rotates the holders 159K, 159C, 159M, and 159Y in the counterclockwise direction by compressing the gear device 130 while being moved in the direction of the driving roller 65 by the cam member 153 to bring the transfer rollers 62K, 62C, 62M, and 62Y into separate from the photoreceptors 40K, 40C, 40M, and 40Y and the intermediate transfer belt 61. Since the slide 155 supports the gear device 130 in the direction of the driving roller 65, the gear device 130 may be rotated in the counterclockwise direction and be in contact with the driving roller 65. The gear device 130 may move to connect the driving roller 65 with the cleaning device 100 to transfer the rotation force of the driving roller 65 to the brush roller 110 of the cleaning device 100. Accordingly, the brush roller 110 is rotated in the standby mode, such that the cleaning device 100 may clean the intermediate transfer belt 61 without any influence on an image formation.

In the standby mode, the cleaning device 100 may clean the inside surface of the intermediate transfer belt 61. As an example, the brush roller 110 receiving the rotation force from the driving roller 65 may rotate in an inverse direction opposite to the running direction of the intermediate transfer belt 61 by the gear device 130. It is possible to improve cleaning efficiency by removing the waste toner remaining on the intermediate transfer belt 61 in one direction by the brush on the outer circumferential surface of the brush roller 110 by the rotation of the brush roller 110. In addition, the toner which is moved by the brush roller 110 and remains on the brush roller 110 may be again removed by the blade 121 having one end which is in contact with the outer circumferential surface of the brush roller 110. The toner removed as described above may be collected and stored in the waste toner collecting box 120.

Since the cleaning device 100 according to an example of the present disclosure may perform a cleaning operation in the standby mode of the image forming apparatus 1 by the gear device 130, quality of an image may be maintained and a life span of the intermediate transfer belt 61 may extend.

FIG. 8 is a view illustrating a sensor for sensing a mode of the transferring device according to an example of the present disclosure.

Referring to FIG. 8, the transferring device 60 according to an example of the present disclosure may include an actuator 161 and a sensor 163 that sense a mode.

The actuator 161 may be installed on the cam shaft 157. The actuator 161 may rotate together with the cam shaft 157 which is rotated according to a mode switching.

The sensor 163 may sense the rotating actuator 161 and sense a mode of the image forming apparatus 1 according to a time at which the sensor 161 is turned on or off. It may be checked whether the transferring device 60 accurately performs the mode switching through a point of time at which the actuator 161 is sensed by the sensor 163. As an example, it may be checked when the actuator 161 is rotated in the clockwise direction that if the sensor 163 senses a first portion M1 of the actuator 161 and a preset time lapses, the transferring device 60 is in the standby mode. It may be checked that if the sensor 163 senses a second portion M2 of the actuator 161 and the preset time lapses, the transferring device 60 is in the mono print mode. It may be checked that if the sensor 163 senses a third portion M3 of the actuator 161 and the preset time lapses, the transferring device 60 is in the color print mode.

Malfunction of the image forming apparatus 1 may be prevented by checking the mode through the sensor 163 for sensing whether or not the transferring device 60 is switched.

FIG. 9 is an enlarged view of a front of a transferring device according to another example of the present disclosure.

Referring to FIG. 9, a transferring device 60' according to another example of the present disclosure may include the intermediate transfer belt 61 the intermediate transfer belt 62, the cleaning device 100, a clutch 130', and the switching device 150.

Since the intermediate transfer belt 61, the intermediate transfer belt 62, the cleaning device 100, and the switching device 150 are the same configurations as those of FIG. 1, an overlapped description thereof will be omitted.

The clutch 130' is to selectively provide driving force to the cleaning device 100 for cleaning the intermediate transfer belt 61 in the case in which the image forming apparatus 1 is in the standby mode, and may selectively provide the rotation force of the driving roller 65 to the cleaning device 100. The clutch 130' may transfer power to the cleaning device 100 in the standby mode to rotate the brush roller 110, and the clutch 130' may be shorted in the printed mode to block the power of the brush roller 110.

The clutch 130' may include a connection clutch 131', a transfer clutch 133', a short elastic member 135', and a clutch shaft 137'.

The connection clutch 131' is to receive the rotation force of the driving roller 65 and may include a gear. The connection clutch 131' may include an upper side gear of the clutch 130' and may be coupled to the transfer clutch 133' to transfer the rotation force of the driving roller 65. The connection clutch 131' may be positioned in a state in which it is connected to the driving roller 65.

The transfer clutch 133' may include a lower side gear of the clutch 130' and may be coupled to the connection clutch 131' to rotate in connection with the connection clutch 131'. The transfer clutch 133' may include a plurality of coupling protrusions that protrude in a direction of the connection clutch 131'.

The connection clutch 131' is provided with a plurality of coupling grooves 132' to which the coupling protrusions 134' of the transfer clutch 133' are insertedly coupled. The coupling grooves 132' may be formed in positions corresponding to the coupling protrusions 134'. The coupling protrusions 134' are insertedly coupled to the coupling grooves 132', such that the connection clutch 131' and the transfer clutch 133' may transfer the rotation force of the driving roller 65 to the brush roller 110 while being rotated together with each other.

The short elastic member 135' may be positioned between the connection clutch 131' and the transfer clutch 133'. The short elastic member 135' compresses the transfer clutch 133' in an opposite direction of the connection clutch 131' so that the connection clutch 131' and the transfer clutch 133' are shorted. The short elastic member 135' elastically compresses the transfer clutch 133' in a direction in which it is separated from the connection clutch 131'. A configuration of the short elastic member 135' for this is not limited, and the short elastic member 135' may be implemented as a coil spring, a plate spring, a fluid spring, or an elastic material such as rubber.

The clutch shaft 137' is to fix positions of the connection clutch 131' and the transfer clutch 133', and the connection clutch 131', the transfer clutch 133', and the short elastic member 135' may be disposed on the clutch shaft 137'.

The transferring device 60' my further include a transfer gear 140' between the clutch 130' and the brush roller 110. The transfer gear 140' may switch the direction of the rotation force of the driving roller 65 to transfer rotation force having a rotation direction opposite to the driving roller 65 to the brush roller 110. The brush roller 110 may be rotated in an inverse direction opposite to the running direction of the intermediate transfer belt 61 by the transfer gear 140'.

In the standby mode, the transfer clutch 133' may move to be coupled to the connection clutch 131', and the connection clutch 131' and the transfer clutch 133' may transfer the rotation force of the driving roller 65 to the brush roller 110 while being rotated together by the coupling between the transfer clutch 133' and the connection clutch 131'.

FIG. 10A is a view illustrating a state in which the transferring device according to another example of the present disclosure is in a print mode and FIG. 10B is a view illustrating a state in which the transferring device according to another example of the present disclosure is in a standby mode.

Referring to FIG. 10A, in a case in which the image forming apparatus 1 is in the print mode, the switching device 150 may switch the transferring device 60' from the standby mode to the print mode.

The switching gear 151 may rotate the cam member 153 and the slide 155 may be moved in the opposite direction of the driving roller 65 by the cam member 153. Since an operation in which the slide 155 of the switching device 150 is moved in the opposite direction of the driving roller 65 is the same operation as that of FIG. 7A, an overlapped description thereof will be omitted.

An insertion portion 155' which is formed integrally with the slide 155 may be moved in the opposite direction of the driving roller 65 as the slide 155 is moved in the opposite direction of the driving roller 65. As the insertion portion 155' that supports the transfer clutch 133' in the direction of the connection clutch 131' is moved in the opposite direction of the driving roller 65, the transfer clutch 133' may be moved in an opposite direction of the connection clutch 131'. The transfer clutch 133' may be elastically compressed in a direction in which it is shorted from the connection clutch 131' by the short elastic member 135/disposed between the transfer clutch 133' and the connection clutch 131'.

As the transfer clutch 133' is moved in the opposite direction of the connection clutch 131', the clutch 130' may be separated. As an example, the coupling protrusions 134' of the transfer clutch 133' may be separated from the coupling grooves 132' of the connection clutch 131'.

The clutch 130' may be shorted in the print mode to block the power of the brush roller 110.

Referring to FIG. 10B, in a case in which the image forming apparatus 1 is in the standby mode, the switching device 150 may switch the transferring device 60' from the print mode to the standby mode.

The switching gear 151 may rotate the cam member 153 and the slide 155 may be moved in the direction of the driving roller 65 by the cam member 153. Since an operation in which the slide 155 of the switching device 150 is moved in the direction of the driving roller 65 is the same operation as that of FIG. 7B, an overlapped description thereof will be omitted.

The insertion portion 155' which is formed integrally with the slide 155 may be moved in the direction of the driving roller 65 as the slide 155 is moved in the direction of the driving roller 65.

The insertion portion 155' may further include an inclined surface 155*a*' which is inclined in a direction of the transfer clutch 133'. The insertion portion 155' may easily enter a lower side of the transfer clutch 133' by the inclined surface 155*a*'. The insertion portion 155' may support the transfer clutch 133' in the direction of the connection clutch 131' in the lower side of the transfer clutch 133'. The coupling protrusions 134' of the transfer clutch 133' are inserted into the coupling groove 132' of the connection clutch 131', such that the transfer clutch 133' and the connection clutch 131' may be coupled to each other.

The connection clutch 131' and the transfer clutch 133' may transfer the rotation force of the driving roller 65 to the brush roller 110 while being rotated together by the coupled clutch 130'. Accordingly, in the standby mode, the cleaning device 100 may clean the inside surface of the intermediate transfer belt 61.

Since the cleaning device 100 according to an example of the present disclosure may perform a cleaning operation in the standby mode of the image forming apparatus 1 by the clutch 130', quality of an image may be maintained and a life span of the intermediate transfer belt 61 may extend.

Hereinabove, the examples of the present disclosure have been illustrated and described, but the present disclosure is not limited to the above-mentioned examples and may be variously modified by those skilled in the art to which the present disclosure pertains without departing from the gist of the present disclosure as defined by the following claims. In addition, these modifications are within the scope of the following claims.

What is claimed is:

1. An image forming apparatus including:

a photoreceptor to have an image formed thereon;

an intermediate transfer belt to transfer the image formed on the photoreceptor;

a driving roller to move the intermediate transfer belt in a running direction;

a cleaning device in a space formed by the intermediate transfer belt to remove a waste toner introduced into the space, the cleaning device including a brush roller to contact the intermediate transfer belt and to rotate in an inverse direction of the running direction of the intermediate transfer belt;

a gear device to couple the driving roller with the brush roller to transfer rotation force of the driving roller to the brush roller; and a switching device to connect the gear device to the driving roller or separate the gear device from the driving roller.

2. The image forming apparatus as claimed in claim 1, wherein the brush roller is to rotate by selectively receiving rotation force of the driving roller.

3. The image forming apparatus as claimed in claim 1, wherein the gear device includes:

a first gear to contact the driving roller to transfer the rotation force; and a second gear to transfer the rotation force from the first gear to the brush roller.

4. The image forming apparatus as claimed in claim 1, wherein the switching device includes:

a switching gear;

a cam member to be rotated by the switching gear, the rotating cam member including a cam trajectory; and a slide including a contact portion to contact the cam trajectory, the slide being movable in a sub-scanning direction by rotating the cam member.

5. The image forming apparatus as claimed in claim 4, further including an elastic member to provide elastic force in a direction in which the gear device is separated from the driving roller.

6. The image forming apparatus as claimed in claim 5, wherein the slide is moved in an opposite direction of the gear device by rotating the driving roller in a print mode in which an image is formed, and the gear device is separated from the driving roller in the print mode.

7. The image forming apparatus as claimed in claim 6, wherein the slide is moved toward the gear device by rotating the driving roller in a standby mode in which an inner portion of the intermediate transfer belt is cleaned by the cleaning device, and the gear device is in contact with the driving roller in the standby mode.

8. The image forming apparatus as claimed in claim 4, further including at least one transfer roller, the transfer roller being movable between a transfer position at which the image is transferred to the intermediate transfer belt to correspond to the photoreceptor and a standby position spaced apart from the transfer position.

9. The image forming apparatus as claimed in claim 1, wherein the cleaning device further includes a waste toner collecting box to collect at least one foreign material of the waste toner and a paper powder which are separated from the brush roller.

10. The image forming apparatus as claimed in claim 9, wherein the cleaning device further includes a blade to be extended to the brush roller to scrape out the waste toner of the brush roller.

11. An image forming apparatus comprising:

a photoreceptor to have an image formed thereon;

an intermediate transfer belt to transfer the image formed on the photoreceptor;

a driving roller to move the intermediate transfer belt in a running direction;

a cleaning device in a space formed by the intermediate transfer belt to remove a waste toner introduced into the space, the cleaning device including a brush roller to contact the intermediate transfer belt and to rotate in an inverse direction of the running direction of the intermediate transfer belt, a blade to be extended to the brush roller to scrape out the waste toner of the brush roller, and a waste toner collecting box to collect at least one foreign material of the waste toner and a paper powder which are separated from the brush roller, the waste toner collecting box further including a blocking member to seal between the waste toner collecting box and the brush roller.

12. A transferring device including:

a frame to have an intermediate transfer belt fixed thereto;

a driving roller to move the intermediate transfer belt in a running direction; and a cleaning device to be disposed in a space formed by the intermediate transfer belt to remove a waste toner introduced into the space, the cleaning device including a brush roller to be disposed to contact the intermediate transfer belt and to rotate in an inverse direction of the running direction of the intermediate transfer belt, a blade to be extended to the brush roller to scrape out the waste toner of the brush roller, and a waste toner collecting box to collect at least one foreign material of the waste toner and a paper powder which are separated from the brush roller, the waste toner collecting box further including a blocking member to seal between the waste toner collecting box and the brush roller.

13. The transferring device as claimed in claim 12, wherein the brush roller is to rotate by selectively receiving rotation force of the driving roller.

14. The transferring device as claimed in claim 12, further including at least one transfer roller, the transfer roller being movable between a transfer position at which the image is transferred to the intermediate transfer belt and a standby position spaced apart from the transfer position.

15. The transferring device as claimed in claim 12, further including:

a gear device to couple the driving roller with the brush roller to transfer rotation force of the driving roller to the brush roller, and a switching device to connect the gear device to the driving roller or separate the gear device from the driving roller.

16. The transferring device as claimed in claim 15, wherein the gear device includes:

a first gear to contact the driving roller to transfer the rotation force; and a second gear to transfer the rotation force from the first gear to the brush roller.

17. The transferring device as claimed in claim 15, wherein the switching device includes:

a switching gear;

a cam member to be rotated by the switching gear, the rotating cam member including a cam trajectory; and a slide including a contact portion to contact the cam trajectory, the slide being movable in a sub-scanning direction by rotating the cam member.

18. The transferring device as claimed in claim 17, further including an elastic member to provide elastic force in a direction in which the gear device is separated from the driving roller.

19. The transferring device as claimed in claim 18, wherein the slide is moved in an opposite direction of the gear device by rotating the driving roller in a print mode in which an image is formed, and the gear device is separated from the driving roller in the print mode.

20. The transferring device as claimed in claim 19, wherein the slide is moved toward the gear device by rotating the driving roller in a standby mode in which an inner portion of the intermediate transfer belt is cleaned by the cleaning device, and the gear device is in contact with the driving roller in the standby mode.

* * * * *